US006530493B2

(12) United States Patent
Anderson

(10) Patent No.: US 6,530,493 B2
(45) **Date of Patent: *Mar. 11, 2003**

(54) SNAP TOP, EASY POURING DISPENSING CAP

(76) Inventor: Raymond G. Anderson, 206 NW. Sharmin Dr., Ankeny, IA (US) 50021

( * ) Notice: Subject to any disclaimer, the term of this patent is extended or adjusted under 35 U.S.C. 154(b) by 97 days.

This patent is subject to a terminal disclaimer.

(21) Appl. No.: 09/898,959

(22) Filed: Jul. 3, 2001

(65) Prior Publication Data

US 2001/0035389 A1 Nov. 1, 2001

Related U.S. Application Data

(63) Continuation of application No. 09/409,533, filed on Sep. 30, 1999, now Pat. No. 6,253,937, which is a continuation of application No. 08/684,018, filed on Jul. 19, 1996, now abandoned, which is a continuation-in-part of application No. 08/471,743, filed on Jun. 6, 1995, now abandoned.

(51) Int. Cl.[7] ..... B65D 41/04
(52) U.S. Cl. ..... 215/235; 215/256
(58) Field of Search ..... 215/235, 256; 220/838

(56) References Cited

U.S. PATENT DOCUMENTS

| | | | | | |
|---|---|---|---|---|---|
| 1,928,445 | A | | 9/1933 | Boyd | 220/847 X |
| 2,610,762 | A | | 9/1952 | Carpenter | 220/291 |
| 2,894,654 | A | | 7/1959 | Lohrer | 215/41 |
| 3,235,117 | A | | 2/1966 | Mason | 215/256 |
| 3,272,368 | A | | 9/1966 | Van Baarn | 215/41 |
| 3,741,447 | A | * | 6/1973 | Miles et al. | 220/838 X |
| 3,874,540 | A | | 4/1975 | Hidding | 215/252 |
| 3,902,621 | A | | 9/1975 | Hidding | 215/252 |
| 3,933,271 | A | * | 1/1976 | McGhie | 220/838 |
| 3,991,904 | A | | 11/1976 | Davis et al. | 215/256 X |
| 4,043,475 | A | | 8/1977 | Wheller | 215/23 |
| 4,129,226 | A | | 12/1978 | Percival | 215/235 |
| 4,287,247 | A | | 9/1981 | Reil et al. | 428/129 |
| 4,371,095 | A | | 2/1983 | Montgomery et al. | 222/153 |
| 4,372,455 | A | | 2/1983 | Cochran | 215/398 X |
| 4,377,247 | A | | 3/1983 | Hazard et al. | 222/517 |
| 4,378,073 | A | | 3/1983 | Luker | 215/237 |
| 4,487,324 | A | | 12/1984 | Ostrowsky | 215/253 |
| 4,625,898 | A | | 12/1986 | Hazard | 222/517 |
| 4,666,068 | A | | 5/1987 | Bush | 222/546 |
| 4,682,702 | A | | 7/1987 | Gach | 215/232 |
| 4,747,498 | A | | 5/1988 | Gach | 215/232 |
| 4,783,056 | A | | 11/1988 | Abrams | 264/40.5 |
| 4,793,501 | A | | 12/1988 | Beck | 215/235 |
| 4,795,043 | A | | 1/1989 | Odet et al. | 215/235 |
| 4,804,119 | A | | 2/1989 | Goodall | 222/468 |
| 4,807,769 | A | | 2/1989 | Gach | 215/235 |
| 4,813,560 | A | * | 3/1989 | Begley | 215/235 |
| 4,860,907 | A | | 8/1989 | Sondal | 215/230 |

(List continued on next page.)

FOREIGN PATENT DOCUMENTS

| | | | |
|---|---|---|---|
| DE | 23 55 818 | 11/1973 | 215/235 |

OTHER PUBLICATIONS

Food & Drug Packaging, Mar. 1989.

Osco Antacid Bottle, Published in the Des Moines Register, Jun. 1996.

*Primary Examiner*—Jes F. Pascua
(74) *Attorney, Agent, or Firm*—McKee, Voorhees & Sease, P.L.C.

(57) ABSTRACT

A single piece injection molded flip top cap for a beverage (or any other non-beverage) container is comprised of a base portion and a lid portion. The base portion forms a substantially large opening to allow for liquids to freely flow through the cap. When the lid is in the closed position, the contents of the container are sealed within the container. By pressing up on a thumb lever, the lid is flipped to an open position allowing the contents to be poured from the container without removing the cap from the container.

12 Claims, 3 Drawing Sheets

U.S. PATENT DOCUMENTS

| | | | | |
|---|---|---|---|---|
| 4,919,286 | A | | 4/1990 | Agbay ..... 215/235 |
| 5,065,938 | A | | 11/1991 | Anderson ..... 229/125.08 |
| 5,088,613 | A | | 2/1992 | Dutt et al. ..... 215/250 |
| 5,104,008 | A | | 4/1992 | Crisci ..... 222/153 |
| 5,108,029 | A | | 4/1992 | Abrams et al. ..... 229/125.09 |
| 5,307,945 | A | | 5/1994 | Hiddings et al. ..... 215/329 |
| 5,307,946 | A | | 5/1994 | Molinaro ..... 215/329 |
| 5,395,006 | A | | 3/1995 | Verma ..... 220/371 |
| 5,437,383 | A | | 8/1995 | Stull ..... 215/235 |
| 5,605,240 | A | | 2/1997 | Guglielmini ..... 215/256 |
| 5,853,093 | A | | 12/1998 | Neiger ..... 215/237 |
| 5,944,207 | A | * | 8/1999 | Reidenbach ..... 215/306 |
| 6,253,937 | B1 | * | 7/2001 | Anderson ..... 215/235 |

* cited by examiner

SNAP TOP, EASY POURING DISPENSING CAP

CROSS-REFERENCE TO RELATED APPLICATIONS

This application is a continuation of application Ser. No. 09/409,533 filed Sep. 30, 1999, now U.S. Pat. No. 6,253,937 issued Jul. 3, 2001, which itself is a continuation of Ser. No. 08/684,018 filed on Jul. 19, 1996 and is now abandoned which is a CIP of Ser. No. 08/471,743 filed Jun. 6, 1995 and is now abandoned.

BACKGROUND OF THE INVENTION

1. Field of the Invention

The present invention relates to liquid and any other non-beverage container closures. More particularly, the present invention relates to an injection molded single piece flip top cap for plastic or paper beverage or any other non-beverage containers.

2. Problems in the Art

There are generally two types of caps presently used on beverage containers (or any other non-beverage containers made of plastic or paper), push-on caps and thread-on caps. Threaded caps generally require the cap to be aligned with the container and a rotative force be applied to the cap to insert or remove the cap from the container. Push-on caps are installed by aligning the cap with the opening of the container and applying a force to the top of the cap. To pour the contents from a container using a push-on or threaded cap, the user must remove the entire cap from the container and then pour the beverage. To close the container, the cap must be inserted on the lid and either screwed on or pushed on. One problem with these types of caps is that when the user wishes to pour the contents from the container, they must either hold on to the cap or set the cap down. It would be convenient if this were not necessary.

Another prior art cap is a combination of the snap-on and screw-off caps. This type of cap can be unscrewed from the container and snapped back on. This type of cap is easier for the consumer to replace on the container. However, the consumer still must either hold-on to the cap or set the cap down while pouring the contents from the container.

It would be desirable to have a cap that allowed the consumer to pour the contents from the container without unscrewing the lid and without separating the cap from the container.

The first plastic milk jugs were produced in 1961. Since that time, the only significant innovations to them are the threads on the lid and the use of a snap-on lid. However, these innovative designs still require the cap to be separated from the container. Companies such as Blackhawk have produced various types of caps for many years, yet have not produced a cap addressing the problems described.

Some prior art flip top caps are known to exist. However, these prior art caps have several disadvantages. First, most prior art flip top caps are not suitable for use with some containers, for example liquid containers. Some prior art caps are comprised of two piece, snap together configuration which increases the production cost and assembly cost. Also, these caps can come apart during use which is undesirable. Other prior art flip top caps are permanently affixed to the container.

FEATURES OF THE INVENTION

A general feature of the present invention is the provision of a flip top beverage container cap.

A further feature of the present invention is the provision of a flip top container cap having a substantially large orifice to facilitate the free flow of a liquid through the cap.

A further feature of the present invention is the provision of a flip top container cap that is comprised of a single piece of material having a living hinge.

A further feature of the present invention is the provision of a flip top container cap that allows the user to pour a beverage or any other non-beverage from the container without removing the cap from the container.

A further feature of the present invention is the provision of a flip top container cap having a thumb flip lever to allow the consumer to easily open the flip top cap.

A further feature of the present invention is the provision of a flip top container cap that can be made in a one mold step.

A further feature of the present invention is the provision of a flip top container cap that can be either a thread-on or snap-on cap.

A further feature of the present invention is the provision of a flip top container cap having threads that are adapted to fit on existing molded containers.

A further feature of the present invention is the provision of a flip top container cap which can come in various sizes and colors to identify a variety of contents.

A further optional feature of the present invention is the provision of a flip top cap which includes a sealing ring between the lid and base.

These as well as other features of the present invention will become apparent from the following specifications and claims.

SUMMARY OF THE INVENTION

The single piece flip top cap of the present invention is adapted to be secured to the opening of a beverage container or any other non-beverage container made of plastic or paper. The flip top cap is a single piece injection molded cap comprising a base portion and a lid portion coupled together with a hinge. The cap also includes a tamper proof ring around the cap and an optional foil seal may be used to seal the container.

The lid includes a thumb lever. By pressing upward on the lever, the lid flips open allowing the user to pour the contents of the container from the container without having to remove the cap. In one embodiment, the base portion forms an opening nearly as large as the opening in the container. When the lid is closed, the lid and base create a seal along the perimeter of the opening to seal the contents within the container.

In another embodiment, a tamper proof ring is attached between the lid and base. The lid is adapted to seal directly onto the opening in the container to seal the contents within the container.

DETAILED DESCRIPTION OF THE PREFERRED EMBODIMENT

Various preferred embodiments of the invention are described in the following detailed description. It is to be understood however, that the invention is not limited to its preferred embodiments; to the contrary, the invention includes various alternatives, modifications and equivalents within its spirit and scope as will be apparent to the skilled artisan.

Figure 1:
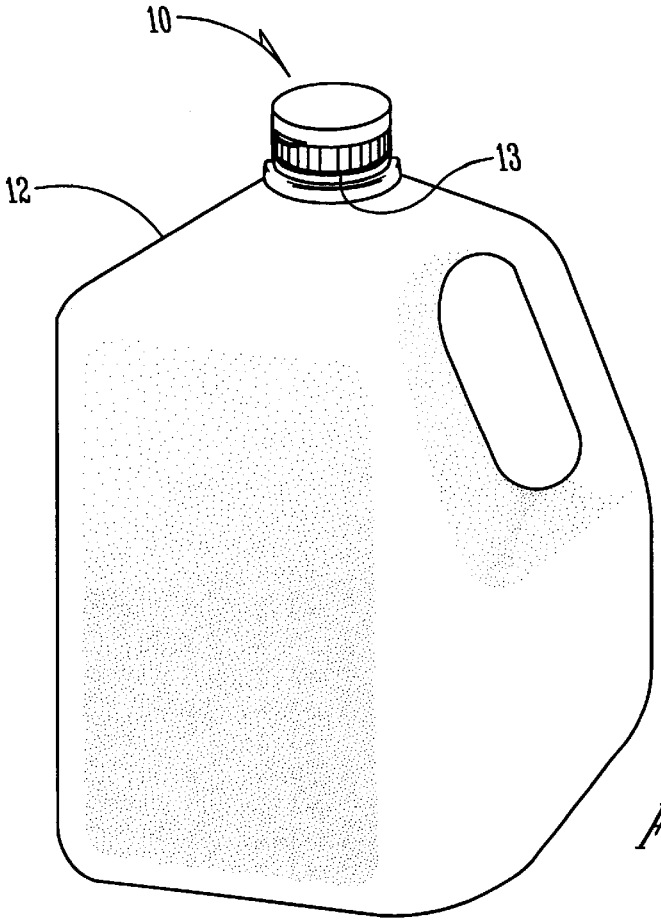
FIG. 1 is a perspective view showing the present invention used with a 1 gallon milk jug.
Figure 2:
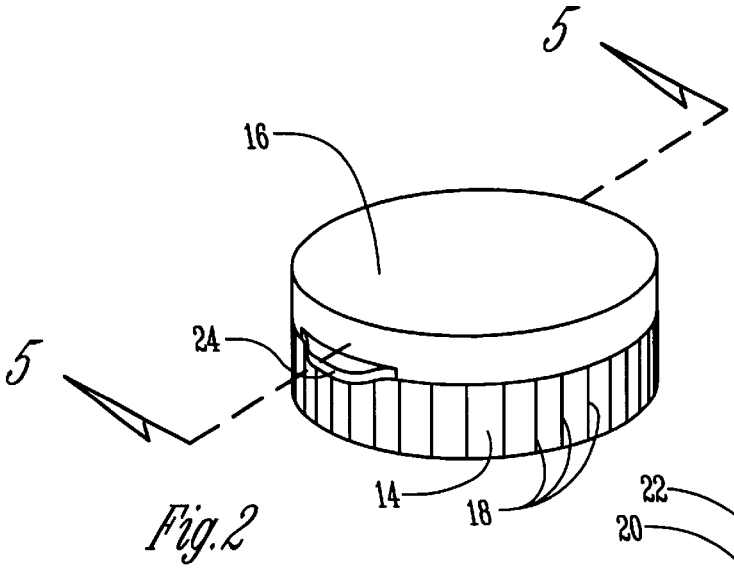
FIG. 2 is a perspective view showing the cap of the present invention in the closed position.
Figure 3:
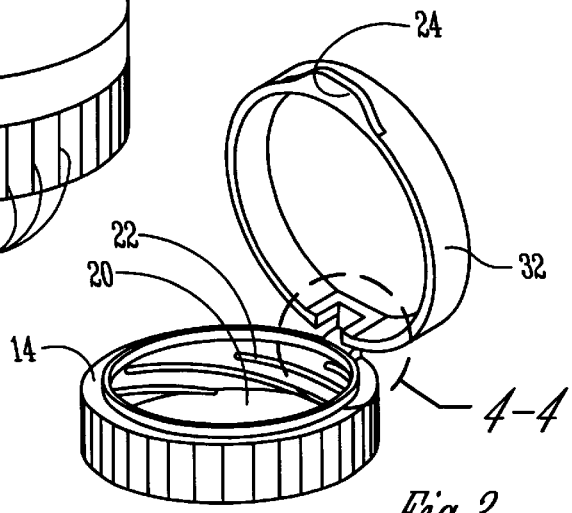
FIG. 3 is a perspective view showing the cap of FIG. 2 in the opened position.

FIG. 1 shows a flip top beverage (or any other non-beverage) container cap 10 attached to a beverage container 12, in this example a 1 gallon milk jug. The cap 10 is attached to the container 12 by a threaded connection or a snap-on connection. A foil seal (not shown) is attached to the container over the opening of the container to seal in the contents within the container. The cap includes a tamper proof ring 13 around the cap 10. Prior to the first use of the container, the cap 10 is twisted to break the tamper proof ring 13 so the cap 10 can be removed. The foil seal is then removed from the container 12. FIG. 2 shows the flip top cap 10 removed from the beverage container 12. The cap 10 includes a base portion 14 and a lid portion 16. The base portion 14 is cylindrical in shape and includes a number of ribbed members 18 to allow the consumer to more easily grip the base portion 14 when inserting or removing the cap 10 from the container 12. As shown in FIG. 3 an opening 20 is formed by the base portion 14. The opening 20 is made as large as possible to allow as much liquid to flow through the base portion as would flow through the top of the container 12 without the cap 10 inserted. On the inside surface of the base 14, a number of threads 22 are formed to allow the cap 10 to screw on or snap-on to the paper or plastic container 12. Note that in place of the threads 22, the cap 10 could be adapted to snap on to the container 12. When the cap 10 is attached to the container 12, the top end of the opening of the container is preferably even with the upper portion of the base 14. However, the top of the container opening could come to any point above or below the top portion of the base 14. The lid portion 16 is cylindrical in shape with one end being opened and the other end being closed. The lid 16 includes a thumb lever 24 which allows the consumer to easily manipulate the lid 16.

Figure 4:
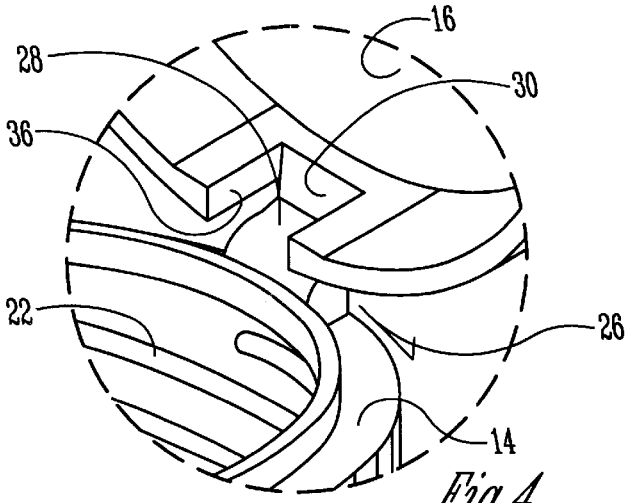
FIG. 4 is a close-up view taken from line 4—4 of FIG. 3 showing the hinge of the cap.

FIG. 4 shows a close up view of the base portion 14 and the lid portion 16. The base 14 and the lid 16 are joined together by living single piece hinge 26. The hinge 26 is comprised of a bottom portion 28 and a top portion 30. The bottom portion 28 is formed near the top of the base 14 of the cap 10. The bottom and top portions of the hinge 26 are joined together and form a single piece living hinge which makes the top 30 and bottom 28 portions moveable with respect to each other.

As shown in FIG. 4, the hinge 26 is coupled to an arcuate portion of the base 14. The hinge 26 as shown is also coupled to an arcuate portion of the lid 16.

Figure 5:
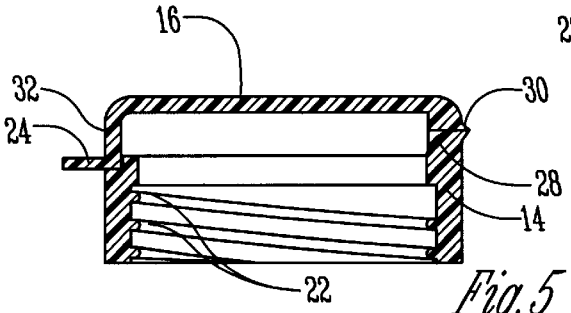
FIG. 5 is a sectional view taken from line 5—5 of FIG. 2.
Figure 4A:
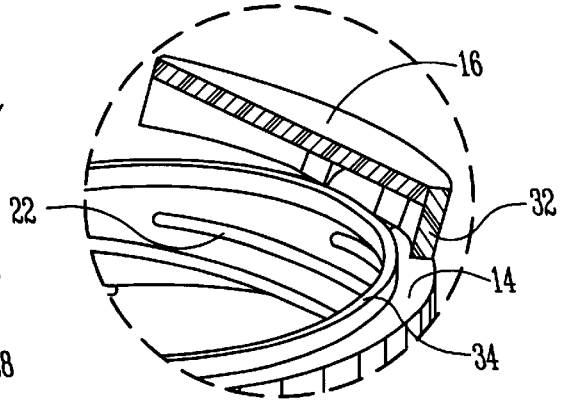
FIG. 4A is a view like FIG. 4 with the lid in a partially opened position.

When the lid 16 is in the closed position the lid wall 32 is in contact with a lip 34 of the base portion 14 sealing the liquids within the container (FIG. 5). The lid 16 also creates a seal with the base 14 in the proximity of the hinge 26. As shown in FIG. 4, the lid wall 32 has a pair of wall edges 36 which form an opening in the wall 32 in the proximity of the hinge 26. As shown in FIG. 4A, as the lid 16 is closed, the wall edges 36 come into contact with the bottom portion 28 of the hinge 26 and also with the lip 34. Therefore, when the lid 16 is completely closed, the lid 16 is sealed against the lip 34 of the bottom portion 14 over the entire circumference of the cap 10.

If the cap 10 uses threads to attach to the container 12, the cap 10 preferably should be manufactured such that when the cap is in the opened position (FIG. 6), the lid 16 projects in the opposite direction of where the contents will be poured to prevent obstruction of the liquid by the lid when pouring. As seen in FIG. 1, in the closed position the thumb lever 24 is positioned on the side of the cap opposite the handle so that when the lid 16 is flipped open, the lid 16 will project towards the handle of the container 12 so that when the contents are poured, the lid 16 will be out of the way and not obstructing the flow of the contents of the container.

The flip top container cap 10 of the present invention can be any color desired. The container cap 10 can also be made of various sizes ranging from personal or individual sized containers to a gallon size or larger. Such containers would include for example, bottled water, milk, juice, sports drinks, non-carbonated beverages or any other non-beverage that retail in various sizes. Preferably, the cap 10 is a single piece, injection molded cap for blow molded or paper containers.

The flip top cap of the present invention could also be used on non-food products, for example on children's bubble solutions. The objective of this cap is the convenience of having a lid with the container at all times and the ease of opening the container. The flip top cap of the present invention would be particularly helpful to physically challenged people such as people with arthritis in their hands or wrists. The cap would also be easier for small children to use since the lid would always be attached to the container and would be easier to open and close.

Figure 6:
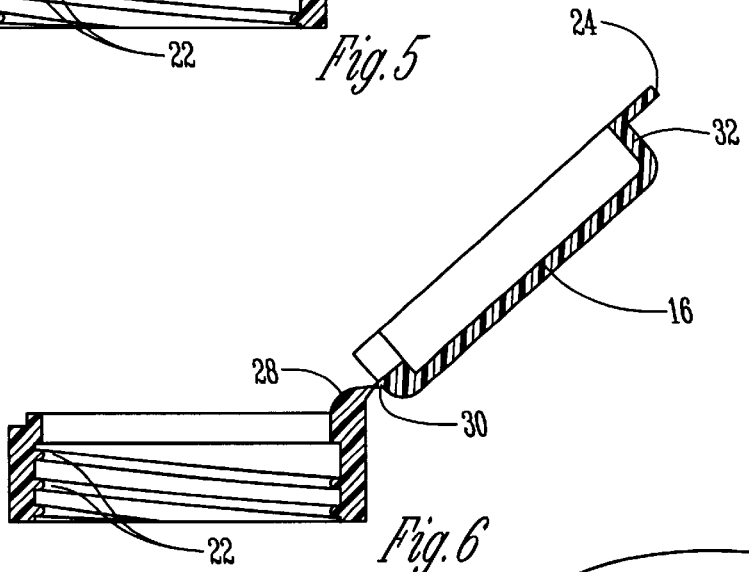
FIG. 6 is a sectional view like FIG. 5 with the lid in the opened position.

The flip top container cap 10 operates as follows. The cap 10 can be made to fit on existing beverage or any other non-beverage containers. In this way, the caps 10 can either be installed on the containers as original caps, or can be inserted on the containers by the consumer after removing the original cap. Once the cap is secured to the container, the consumer will not need to remove the cap again. When the consumer wants to pour the contents from the container, the thumb lever 24 is pressed upward in relation to the container causing the lid 16 to flip in the open position (FIGS. 3 and 6). The consumer can then pour the contents from the container without holding on to the cap or setting the cap aside as is required in the prior art. Also, because of the design of the hinge 26, the lid 16 will stay in the open position (FIG. 6) without the user having to hold it open. When the user is finished pouring the contents, the lid 16 can be easily moved to the closed position (FIGS. 1 and 5) by pressing on the lid 16. When the cap 10 is in the closed position, the lid 16 and the lip 34 of the base 14 form a seal for sealing the contents in the container.

Figure 7:
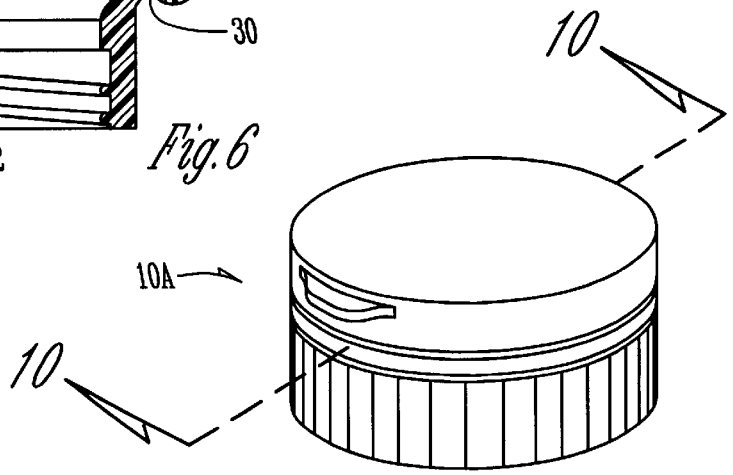
FIG. 7 is a perspective view showing a cap of the present invention with a tamper proof ring between the base and the lid.
Figure 8:
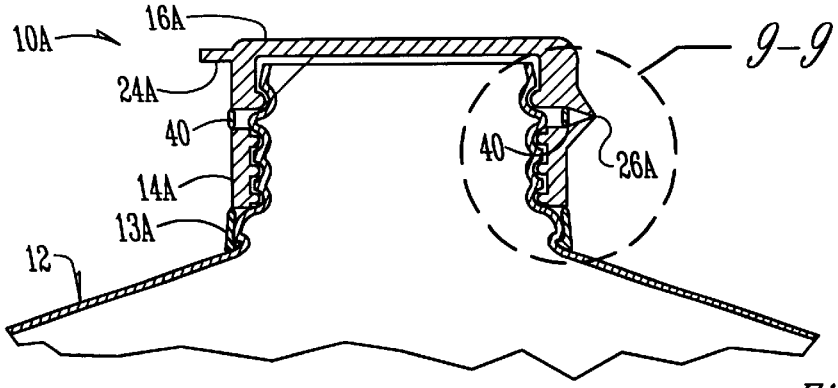
FIG. 8 is a cross-section of the cap shown in FIG. 7 including a portion of the containers

FIG. 7 shows an alternative embodiment of the present invention. FIG. 7 shows a flip top cap 10A which, like the cap 10, can either screw or snap on to the container 12. Cap 10A includes a base 14A connected by a hinge 26A to a lid 16A. The cap 10A is a single piece molded cap with a living hinge. The hinge 26A is comprised of a pair of angled hinge members 48 and 50 which extend from the lid 16A and base 14A and come together to form the hinge. The hinge 26A has approximately the same width as the hinge 26 shown in FIGS. 1–6. The portion of the hinge 26A where members 48 and 50 meet has a small cross section which allows the lid 16A to stay in the open position once it is opened by the user. While the hinge 26A is movable to allow the lid 16A to be opened and closed, the hinge 26A is also rigid enough that when a user applies pressure to the lid 16A in the open position, no matter where that pressure is applied, the hinge 26A will ensure that the lid 16A will engage the opening of the container 12 without the user having to align the lid 16A with the opening of the container.

The angled hinge members 48 and 50 also create a gap between the lid 16A and the base 14A. As shown in the Figures, a tamperproof seal 40 is attached to the base 14A and lid 16A between this gap. The tamper proof seal is used to indicate when the container has been opened.

Figure 9:
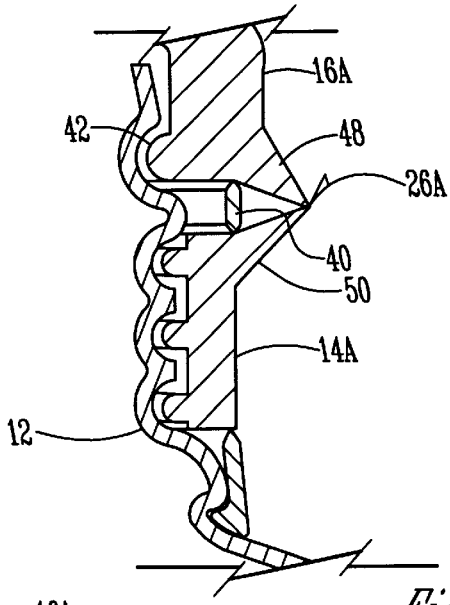
FIG. 9 is an enlarged view taken from line 9—9 of FIG. 8.
Figure 10:
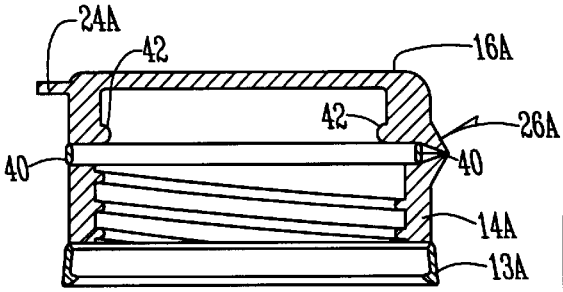
FIG. 10 is a cross section taken from line 10—10 of FIG. 7.
Figure 11:
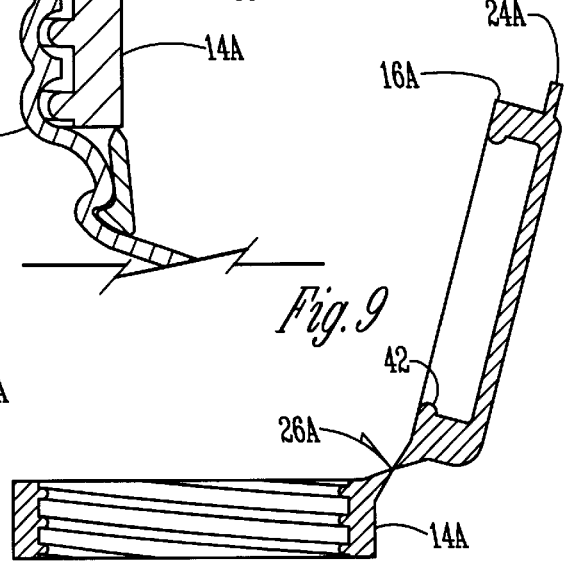
FIG. 11 shows the view of FIG. 10 with the cap in the open position.

Before the initial use of the cap 10A, the tamper proof seal 40 prevents the lid 16A from opening. The user can remove the tamper proof seal 40 by tearing the seal 40 away from the cap 10A. This frees the lid 16A to open. After the seal 40 is removed, there will be a gap between the base 14A and the lid 16A. Since there is no contact made between the lid 16A and the base 14A when the cap 10A is in the closed position, the lid 16A must make the seal with the container 12. This is accomplished by an annular sealing member 42 which is formed in the lid 16A around the lower inside surface of the lid 16A. When the lid 16A is in the closed position, the sealing member 42 will press against and engage with the container as shown best in FIG. 9. Note that in the Figures, a small gap is shown between the container 12 and the sealing member 42. This gap is shown for clarity only. When the lid 16A is sealed onto the container 12, the member 42 fits tightly to the container 12.

As can be seen in the Figures, when the cap 10A is used, no portion of the cap 10A will obstruct the flow of the contents from the container 12. When the lid 16A is open, the base 14A is well below the opening of the container.

A tamper proof ring 13A may optionally be included. The ring 13A functions like the ring 13 discussed above. The ring 13A prevents the cap 10A from being removed without breaking the ring 13A. Alternatively, or in addition to the ring 13A, a foil seal may be included over the top of the container.

Figure 12:
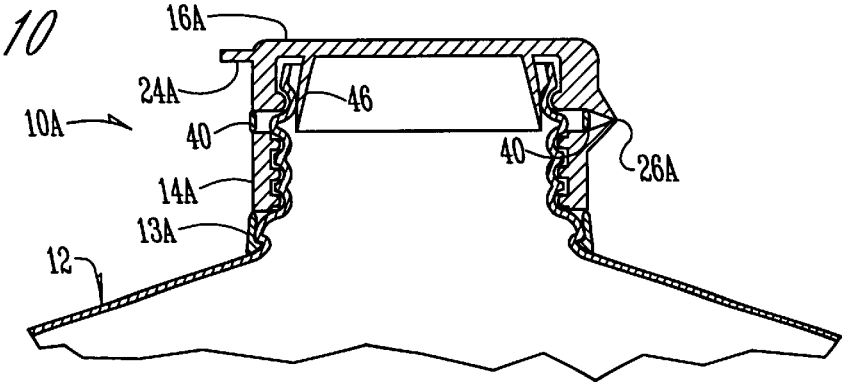
FIG. 12 is a view like FIG. 8 with a sealing ring included.

FIG. 12 shows the cap 10A with an optional annular sealing ring 46. The sealing ring 46 will fit inside the orifice of the container as shown in FIG. 12 to seal the contents inside the container.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A liquid containing system having a single piece flip top cap comprising:

a container at least partially filled with a beverage;

a base adapted for attachment to a pouring orifice of the container, the base being positioned at least partially below the orifice of the container when the base is attached to the container and having an opening substantially aligned with the orifice of the container when the base is attached to the container such that the base does riot substantially obstruct the free flow of the contents from the container;

said base having a coupling adapted to attach to a similar coupling formed on the container and also a sealing upper lip;

a flip top lid having a thumb lever, and being hingedly coupled to the base such that the flip top lid is movable between a first position and a second position, said first position being substantially parallel to the base such that the lid covers the opening in the base and in conjunction with said sealing upper lip, seals the opening in the base, said second position being away from the opening in the base of the container and free from the sealing upper up such that the flip top lid does not obstruct the free flow pouring of any contents from the container; and a hinge coupled to both an arcuate portion of the base and the flip top lid, the hinge being formed from the same material as the base and the lid.

2. The single piece flip top cap of claim 1 wherein the hinge comprises a living hinge attached to both the lid and the base.

3. The single piece flip top cap of claim 1 which is an injection molded piece.

4. The single piece flip top lid of claim 1 wherein the flip top lid includes an arcuate flip top lid portion, the hinge coupled to the arcuate flip top lid portion.

5. A combination of a milk jug and a flip top cap comprising:

a milk jug having a handle and a cylindrical shaped orifice wall defining an orifice;

a base adapted for attachment to a pouring orifice of the container, the base being positioned at least partially below the orifice of the container when the base is attached to the container and having an opening substantially aligned with the orifice of the container when the base is attached to the container such that the base does not substantially obstruct the free flow of the container contents from the container;

said base having a coupling adapted to attach to a similar coupling formed on the container and also having a sealing upper lip;

a flip top lid having a thumb lever, and being hingedly coupled to the base such that the flip top lid is movable between a first position and a second position, said first position being substantially parallel to the base such that the lid covers the opening in the base and in conjunction with said sealing upper lip, seals the opening in the base, said second position being away from the opening in the base of the container and free from the sealing upper lip such that the flip top lid does not obstruct the free flow pouring of any contents from the container; and, a hinge coupled to both an arcuate portion of the base and the flip top lid, the hinge being formed from the same material as the base and the lid.

6. The single piece flip top cap of claim 5 which is an injection molded piece.

7. The combination of a milk jug and a flip top cap of claim 5 wherein the flip top lid includes an arcuate flip top lid portion, the hinge coupled to the arcuate flip top lid portion.

8. A liquid containing system having a single piece flip top cap, comprising:

a container at least partially filled with a liquid;

a base adapted for attachment to a pouring orifice of the container, the base being positioned at least partially below the orifice of the container when the base is attached to the container and having an opening substantially aligned with the orifice of the container when the base is attached to the container such that the base does not substantially obstruct the free flow of the contents from the container;

said base having a coupling adapted to attach to a similar coupling formed on the container and also a sealing upper lip;

a flip top lid having a thumb lever, and being coupled to the base by a living hinge such that the flip top lid is movable between a first position and a second position, said first position being substantially parallel to the base such that the lid covers the opening in the base and in conjunction wit said sealing upper lip, seals the opening in the base, said second position being away from the opening in the base of the container and free from the sealing upper lip such that the flip top lid does not obstruct the free flow pouring of any contents from the container; and a hinge coupled to both an arcuate portion of the base and the flip top lid, the hinge being formed from the same material as the base and the lid.

9. The single piece flip top cap of claim 8 wherein the flip top lid includes an arcuate flip top lid portion, the hinge coupled to the arcuate flip top lid portion.

10. A liquid containing system having a single piece flip top cap, comprising:

a container at least partially filled with a liquid;

a base adapted for attachment to a pouring orifice of the container, the base being positioned at least partially below the orifice of the container when the base is attached to the container and having an opening substantially aligned with the orifice of the container when the base is attached to the container and having an opening substantially aligned with the orifice of the container when the base is attached to the container such tat the base does not substantially obstruct the free flow of the contents from the container;

said base having a coupling adapted to attach to a similar coupling formed on the container and also a sealing upper lip;

a flip top lid having a thumb lever, and being hingedly coupled to the base such that the flip top lid is movable between a first position and a second position, said first position being substantially parallel to the base such that the lid covers the opening in the base and in conjunction with said sealing upper lip, seals the opening in the base, and second position being away from the opening in the base of the container and free from the sealing upper lip such that the flip top lid does not obstruct the free flow pouring of any contents front the container; and a hinge coupled to both the base and an arcuate portion of the flip top lid, the hinge being formed from the same material as the base and the lid.

11. The single piece flip top lid of claim 10 wherein the base includes an arcuate base portion, the hinge coupled to the arcuate base portion.

12. A liquid containing system comprising:

a container at least partially filled with a liquid;

a base adapted for attachment to a pouring orifice of the container, the base being positioned at least partially below the orifice of the container when the base is attached to the container and having an opening substantially aligned with the orifice of the container when the base is attached to the container such that the base does not substantially obstruct the free flow of the contents from the container;

said base having a coupling adapted to attach to a similar coupling formed on the container and also a sealing upper lip;

a flip top lid having a thumb lever, and being hingedly coupled to the base such that the flip top lid is movable between a first position and a second position, said first position being substantially parallel to the base such that the lid covers the opening in the base and in conjunction with said sealing upper lip, seals the opening in the base, said second position being away from the opening in the base of the container and free from the scaling upper lip such that the flip top lid does not obstruct the free flow pouring of any contents from the container; and at least one hinge coupled to both an arcuate portion of the base and the flip top lid, the at least one hinge being fanned from the same material as the base and the lid.

* * * * *